United States Patent [19]

Cavazza

[11] 4,195,731

[45] Apr. 1, 1980

[54] DEVICE FOR CONTAINING A SUBSTANCE TO BE MIXED WITH ANOTHER SUBSTANCE IN A VIAL

[76] Inventor: Claudio Cavazza, via Marocco 35, Rome, Italy

[21] Appl. No.: 920,330

[22] Filed: Jun. 29, 1978

[30] Foreign Application Priority Data

Apr. 27, 1978 [IT] Italy ..... 22764 A/78

[51] Int. Cl.[2] ..... B65D 25/08

[52] U.S. Cl. ..... 206/222; 215/223; 215/DIG. 8; 366/602

[58] Field of Search ..... 128/272.1; 206/219-222, 568; 215/6, 208, 223, 227, 250, DIG. 8; 220/258, 329; 366/602

[56] References Cited

U.S. PATENT DOCUMENTS

| | | | |
|---|---|---|---|
| 3,603,469 | 9/1971 | Monza | 206/222 |
| 3,771,682 | 2/1972 | Chacos | 215/208 |
| 3,840,136 | 10/1974 | Lanfranconi et al. | 206/222 X |
| 4,102,451 | 7/1978 | Clarke et al. | 206/219 |

FOREIGN PATENT DOCUMENTS

| | | | |
|---|---|---|---|
| 472521 | 7/1973 | Australia | 206/222 |
| 2441406 | 3/1975 | Fed. Rep. of Germany | 215/DIG. 8 |
| 2754100 | 12/1977 | Fed. Rep. of Germany | 206/222 |
| 1231770 | 5/1971 | United Kingdom | 206/222 |

*Primary Examiner*—Steven E. Lipman
*Attorney, Agent, or Firm*—McGlew and Tuttle

[57] ABSTRACT

A device for containing a substance and adapted to release the substance into a vial comprising a container adapted to be supported on the vial having a cylindrical space adapted to contain the substance with a closing bottom connected thereto for closing the cylindrical space and retaining the substance. A piercing piston is slidably mounted within the cylindrical space of the container and provided with a lower piercing point for piercing through a weakness defined between the container and its closing bottom. A vertically and circumferentially extending groove is defined in the container within the circumferential space and a projection is defined on the piercing piston which in engaged within the groove. The groove and projection thus restricts the sliding motion of the piercing piston to permit the piercing piston to be slid downwardly to pierce through the weakness defined between the container and its closing bottom only when the piercing piston is at a selected predetermined rotational position so that its piercing point is positioned over the weakness.

1 Claim, 4 Drawing Figures

DEVICE FOR CONTAINING A SUBSTANCE TO BE MIXED WITH ANOTHER SUBSTANCE IN A VIAL

BACKGROUND OF THE INVENTION

1. Field of the Invention

The present invention relates to a device for obtaining the admixture of two products which are kept separate up to the moment of use. The device uses torsional fit means connected between a cylinder which contains one of the product and the piston which effects a piercing action when manually operated to pierce the cylinder.

2. Description of the Prior Art

There have been known for some time devices consisting essentially of a cylindrical container and of a piercing piston positioned normally within the container and acting as the closure means for vials and the like, the entire assembly being protected by a sealing cap which can be removed. These known devices present essentially two types of inconvenience. The first is that since the relative rotational positioning between the cylinder-container and the piercing piston is unrestricted and uncontrolled, the piercing point of the piston, which is cut at an angle to form a fluted sharp point, may encounter parts of particular resistance in the bottom which is to be pierced. This necessitates a particular application of force on the part of the user or the need for tools. A second problem is that notwithstanding the presence of the sealing cap, an accidental axial bump may provoke a premature piercing of the bottom of the cylinder-container, with the resulting premature admixture of the two products.

SUMMARY OF THE INVENTION

To eliminate such inconveniences, the present invention provides means for defining a rotational or a torsional fit between the cylinder-container and the piercing piston, so that the point of the piston always contacts a weakened point or portion on the bottom of the cylinder to be pierced. Such weakened portion can be defined during a stamping operation. This mutually coactive means can be provided so that the piston can be pushed to provide the piercing action only in a position which is obtained by the rotation of the piston with respect to the cylinder-container. There is thus avoided the possibility of accidental piercing due to an axial bump on the piston.

Accordingly, an object of the present invention is to provide a device for containing a substance and adapted to release the substance into a vial comprising: a substance container adapted to be supported on the vial having a cylindrical space defined therein adapted to contain the substance; a closing bottom connected to said container for closing the bottom of said cylindrical space and retaining the substance, with a weakened section defined between said closing bottom and said container; a piercing piston slidably mounted in said cylindrical space having a piercing point adapted to break said weakened section to open said closing bottom and release the substance; and means connected between said piercing piston and said container for restricting the sliding of said piercing piston within said cylindrical space so that said piercing piston can be slid downwardly to pierce said weakened section only when said piercing piston is disposed at a selected rotational relationship with said container.

A further object of the present invention is to provide a device for containing a substance which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
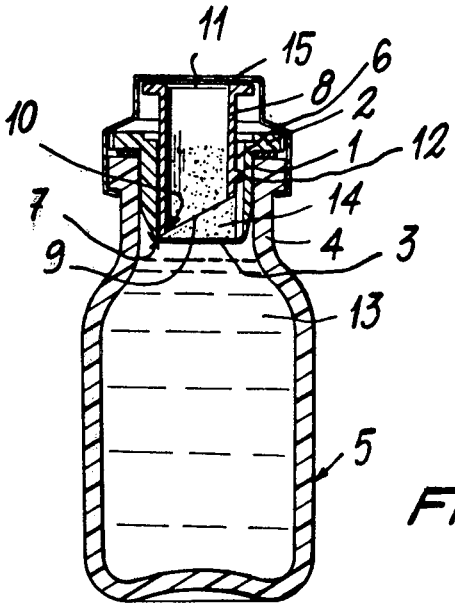
FIGS. 1 and 2 show respectively a vial equipped with the device of the present invention before and after the piercing operation.

A device according to the invention is substantially composed of a cylinder-container or substance container 1 having an upper flange 2 and a lower closing bottom 3 which is adapted to be supported on the inside of a neck 4 of a vial, indicated as a whole as 5. According to the invention, on the interior wall of the cylinder there is provided a circumferentially and vertically extending groove 6, while on the bottom 3 of the cylinder there is provided a weakened portion or section 7 obtained, for example, by providing a thinner layer of the material in this area during a stamping operation.

The device according to the invention is completed by providing a piercing piston 8 terminating which is slidably mounted in the container 1 and which terminates on its lower end with a fluted or angled section 9. The lowermost point of section 9 has been indicated at 10 which is pointed. The upper part of piston 8 is closed by a wall 11 on which one must act manually to effect a piercing action. According to the invention, on the outer surface of piston 8 there is provided a projection or tongue 12 for example of a hemispherical shape, adapted to engage the groove 6 of the cylinder-container. The position of the projection 12 and of the corresponding groove 6 are such as to place the piercing point 10 at the lower extremity of the piston in correspondence with the cited weakened point 7 of bottom 3.

The device as a whole is positioned on the neck 4 of vial 5 which normally contains a liquid product 13 to be admixed at the moment of use with a product 14, for example of a powdery nature, contained on the inside of cylinder-container 1 between the bottom 3 and the lower part of the piston 8; the device can be completed by a conventional sealing cap 15 which locks it on the neck of the container, this sealing cap being manually openable at the moment of use.

The operation of the device according to the invention should be obvious from the preceding description and can be thus briefly summarized: at the moment of use of the product, the sealing cap 15 is removed; the head 11 of piston 8 is then pressed manually; the piston slides axially with respect to the cylinder-container 1 and the fluted point 10 effects the piercing of bottom 3; according to the invention, due to the reciprocal torsional engagement between piston 8 and cylinder 1, due to the projection 12 which is forced to slide in groove 6, one has the certainty that the terminal point 10 of the fluted end 9 always comes in contact with the weakened point 7 of the bottom 3.

Figure 2:
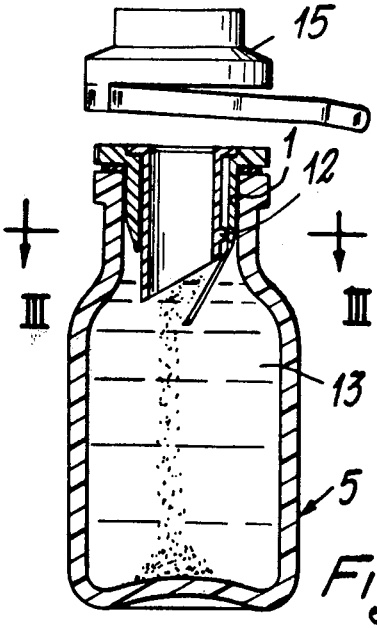
Figure 3:
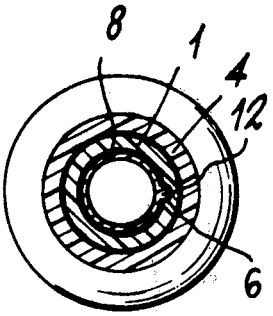
FIG. 3 is a section taken along axis III—III of FIG. 2.
Figure 4:
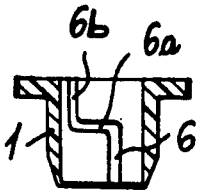
FIG. 4 is a diametral section of a cylinder-container showing an S-shaped guide which cooperates with a corresponding projection of the piercing piston.

According to a variation illustrated in FIG. 4, the groove provided on the internal surface of the cylinder-container can be composed of a first vertical section *6b*, of a second substantially horizontal or circumferential section aligned with weakness 7 and *6a* and finally of a section corresponding exactly to that described with reference to FIGS. 1 to 3. Such disposition of the groove prevents the accidental lowering of piston 8 inasmuch as the projection 12 cannot superate accidentally the horizontal section *6a* of the groove; the action of the device is thus only possible by effecting first a rotation of the piston with respect to the cylinder such as to bring the projection 12 to correspond with final vertical section 6, after which it is possible to act axially on the piston to effect the piercing action; therefore the opening or piercing can only be obtained by the combination of a rotation and of a successive axial push on the piston (turn and push action).

It should be obvious from the preceding description that the means confining the circumferential and vertical sliding of the piston connected for the reciprocal torsional coaction between piston and cylinder-container may be different from those illustrated and described. In particular, the reciprocal positions of the tongue-and-groove arrangement can be inverted by providing a projection on the cylinder wall adapted to engage a groove on the piston.

While there have been described only some embodiments of the present invention, it will now be simple for one skilled in the art to arrive at various modifications and changes which should all be considered included within the ambit of the present invention.

What is claimed is:

1. A device for containing a substance and adapted for releasing the substance into a vial containing another substance comprising;

a cylindrical substance container adapted to be supported on and enclose a top opening of the vial having a cylindrical space defined therein and including a top flange portion engageable around the top of the vial;

a closing bottom connected to the bottom of said substance container for closing the bottom of said cylindrical space to contain the substance therein, said connection between said closing bottom and said container being substantially circular and including one weakened section at a selected circumferential location of the connection;

a substantially cylindrical hollow piercing piston having a top cover wall vertically and circumferentially slidably engaged in said cylindrical space of said substance container, said piercing piston having a lower end extending in an angle with respect to said closing bottom, said lower end terminating at its bottom in a piercing point adapted for breaking said weakened section when said piercing piston is slid vertically downwardly through said weakened section;

one of said container and said piercing piston including a groove facing the other of said container and said piercing piston having at least one circumferentially extending portion and at least one vertically extending portion; and a projection defined on the other of said containers and piercing piston engaged with said groove for confining the circumferential and vertical sliding of said piercing piston with respect to said substance container;

one of said projection and said vertical portion of said groove aligned with said weakened section so that said piercing piston is slidable circumferentially to align said piercing point with said weakened section and, thereafter, slidable vertically to pierce said weakened section and release the substance within said substance container into the vial.

* * * * *